US006048238A

United States Patent [19]

Tsai

[11] Patent Number: 6,048,238

[45] Date of Patent: Apr. 11, 2000

[54] SWIMMING AID DEVICE

[76] Inventor: Yen-Wen Tsai, 144, Lane 509, Pei Tun Road, Taichung, Taiwan

[21] Appl. No.: 09/296,679

[22] Filed: Apr. 20, 1999

[30] Foreign Application Priority Data

Oct. 9, 1998 [TW] Taiwan ..... 87216789

[51] Int. Cl.[7] ..... A63B 31/11

[52] U.S. Cl. ..... 441/61

[58] Field of Search ..... 441/55, 60, 61, 441/62, 63, 64

[56] References Cited

U.S. PATENT DOCUMENTS 5,545,066 8/1996 Tsai ..... 441/61

*Primary Examiner*—S. Joseph Morano
*Assistant Examiner*—Patrick Craig Muldoon

[57] ABSTRACT

A swimming aid device has a generally grid-shaped frame, a toes strap, an instep strap, and a heel strap. A reinforced rib and a crossbar are disposed on the front portion of the frame. The toe strap is disposed on the front portion of the frame. The instep strap is disposed on a central portion of the frame. The heel strap is disposed on a rear portion of the frame. A female fastening device is disposed at an end of the toe strap. A male fastening device engages with the female fastening device. A first blocking plate is disposed at an end portion of the cross strap. The first blocking plate has a first distal protruded bar. A second blocking plate is disposed at an end portion of the instep strap. The second blocking plate has a second distal protruded bar.

4 Claims, 4 Drawing Sheets

SWIMMING AID DEVICE

BACKGROUND OF THE INVENTION

The invention relates to a swimming aid device. More particularly, the invention relates to a swimming aid device which has adjustable straps to fit a barefoot and various diving boots very well.

U.S. Pat. No. 5,545,066 has disclosed a swimming aid assemble which has a generally grid-shaped frame with transverse bars and longitudinal rods. Each transverse bar is connected to a leaf. Four reinforced ribs are disposed on the frame. A first retaining ring is disposed at an end of a toe strap. A longitudinal instep strap and a longitudinal first heel strap are crossed by a first cross strap. The first heel strap is disposed at an end portion of the first cross strap. The longitudinal instep strap and a longitudinal second heel strap are crossed by a second cross strap. The longitudinal second heel strap is disposed at a middle portion of the second cross strap. The first cross strap is disposed at an end portion of the longitudinal instep strap. The second cross strap is disposed at a center portion of the longitudinal instep strap. A second retaining ring is disposed at an end of the instep strap. A third retaining ring is disposed at an end of the first cross strap. The above-mentioned straps are made of hook and loop type fasteners which have male tapes such as hook tapes or female tapes such as loop tapes. However, the hook and loop type fasteners may be disengaged from each other after a long period of usage in water.

SUMMARY OF THE INVENTION

An object of the invention is to provide a swimming aid device which has adjustable straps to fit a barefoot very well at one time and various diving boots very well at other times.

Another object of the invention is to provide a swimming aid device which has an annular female fastening device and a T-shaped male fastening device engaging with the annular female fastening device in order to fasten the hook and loop type toe strap stably. The T-shaped male fastening device will not be disengaged from the annular female fastening device.

Another object of the invention is to provide a swimming aid device which has a first blocking plate having a first distal protruded bar to facilitate the operation of a cross strap with one hand in water.

Another object of the invention is to provide a swimming aid device which has a second blocking plate having a second distal protruded bar to facilitate the operation of an instep strap with one hand in water.

Accordingly, a swimming aid device comprises a generally grid-shaped frame, a hook and loop type toe strap, a hook and loop type instep strap, a hook and loop type heel strap, an annular female fastening device, a T-shaped male fastening device, a first blocking plate, and a second blocking plate. The generally grid-shaped frame has a plurality of spaced transverse bars, a plurality of spaced longitudinal rods, and a plurality of meshes defined by the spaced transverse bars and the spaced longitudinal rods. Each transverse bar is connected to a leaf. Each leaf covers the respective mesh. A reinforced rib is disposed on a front portion of the generally grid-shaped frame transversely. A crossbar is disposed on the front portion of the generally grid-shaped frame between two of the longitudinal rods. The hook and loop type toe strap is disposed on the front portion of the generally grid-shaped frame. A first positioning pad is disposed on the front portion of the generally grid-shaped frame to position a center portion of the hook and loop type toe strap. The hook and loop type instep strap is disposed on a generally central portion of the generally grid-shaped frame. A second positioning pad is disposed on the generally central portion of the generally grid-shaped frame to position a center portion of the hook and loop type instep strap. The hook and loop type heel strap is disposed on a rear portion of the generally grid-shaped frame. A third positioning pad is disposed on the rear portion of the generally grid-shaped frame to position a center portion of the hook and loop type heel strap. A first cross strap is disposed at an end portion of the hook and loop type instep strap. A second cross strap is connected to the hook and loop type instep strap and the hook and loop type heel strap. A first retaining ring is disposed at a terminal end of the first cross strap. A second retaining ring is disposed at a terminal end of the second cross strap. The annular female fastening device is disposed at a terminal end of the hook and loop type toe strap. The annular female fastening device has two upper positioning posts. Each of the upper positioning posts has a disk head, a first annular recess, and a second annular recess. The T-shaped male fastening device engages with the annular female fastening device. The T-shaped male fastening device has an upper plate, and a lower insertion block inserted in the annular female fastening device. The upper plate has two through holes. A plurality of protruded blocks are disposed in each of the through holes. Each of the upper positioning posts is inserted in the respective through holes. Each of the protruded blocks engaes with the respective first annular recess while the upper plate is pressed downward and the lower insertion block is inserted in the annular female fastening device. Each of the protruded blocks engages with the respective second annular recess while the upper plate is pulled upward and the lower insertion block disengages from the annular female fastening device. The first blocking plate is disposed at an end portion of the second cross strap. The first blocking plate has a first distal protruded bar. The second blocking plate is disposed at an end portion of the hook and loop type instep strap. The second blocking plate has a second distal protruded bar.

DETAILED DESCRIPTION OF THE INVENTION

Figure 1:
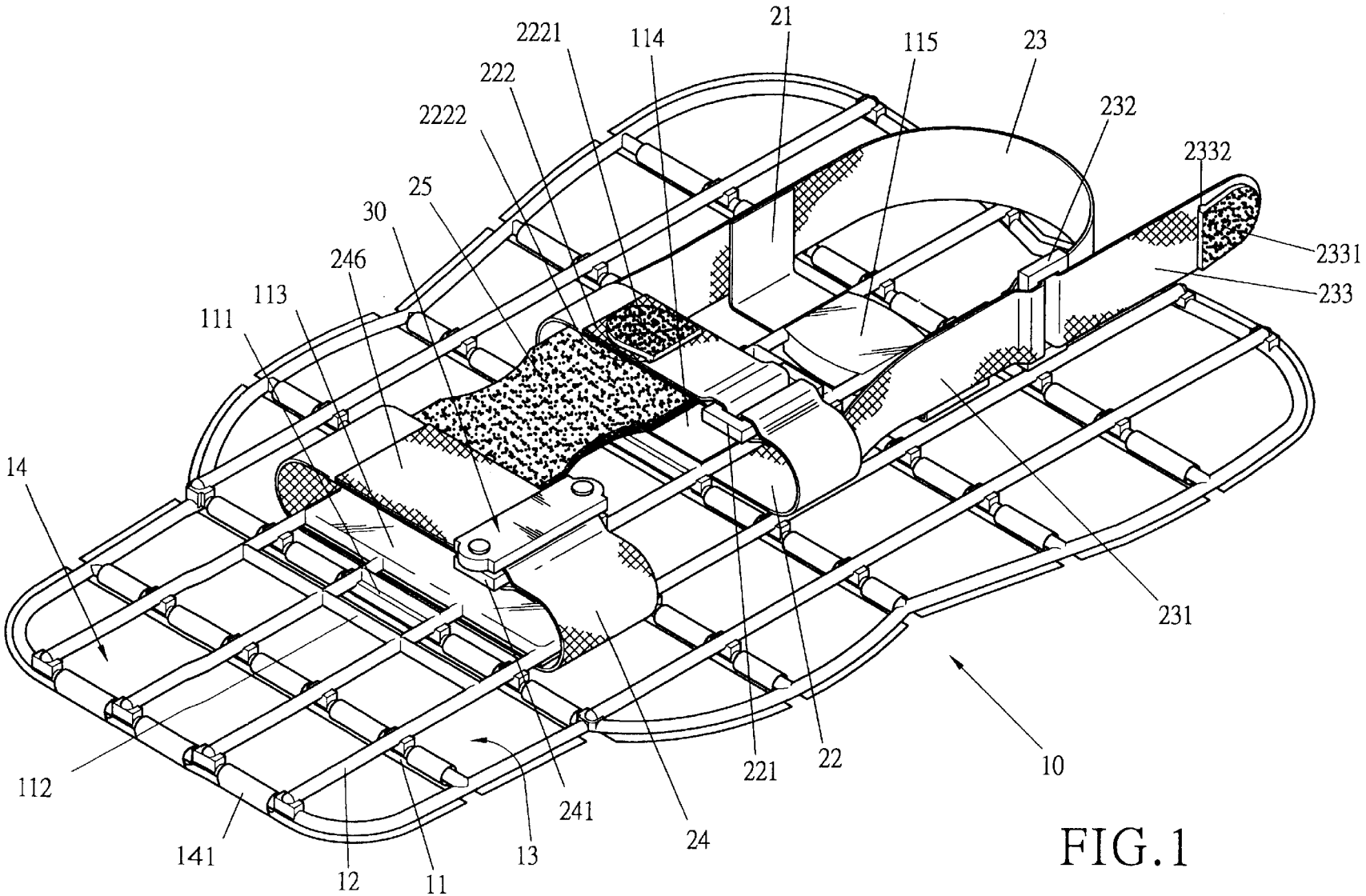
FIG. 1 is a perspective assembly view of a swimming aid device of a preferred embodiment in accordance with the invention.
Figure 2:
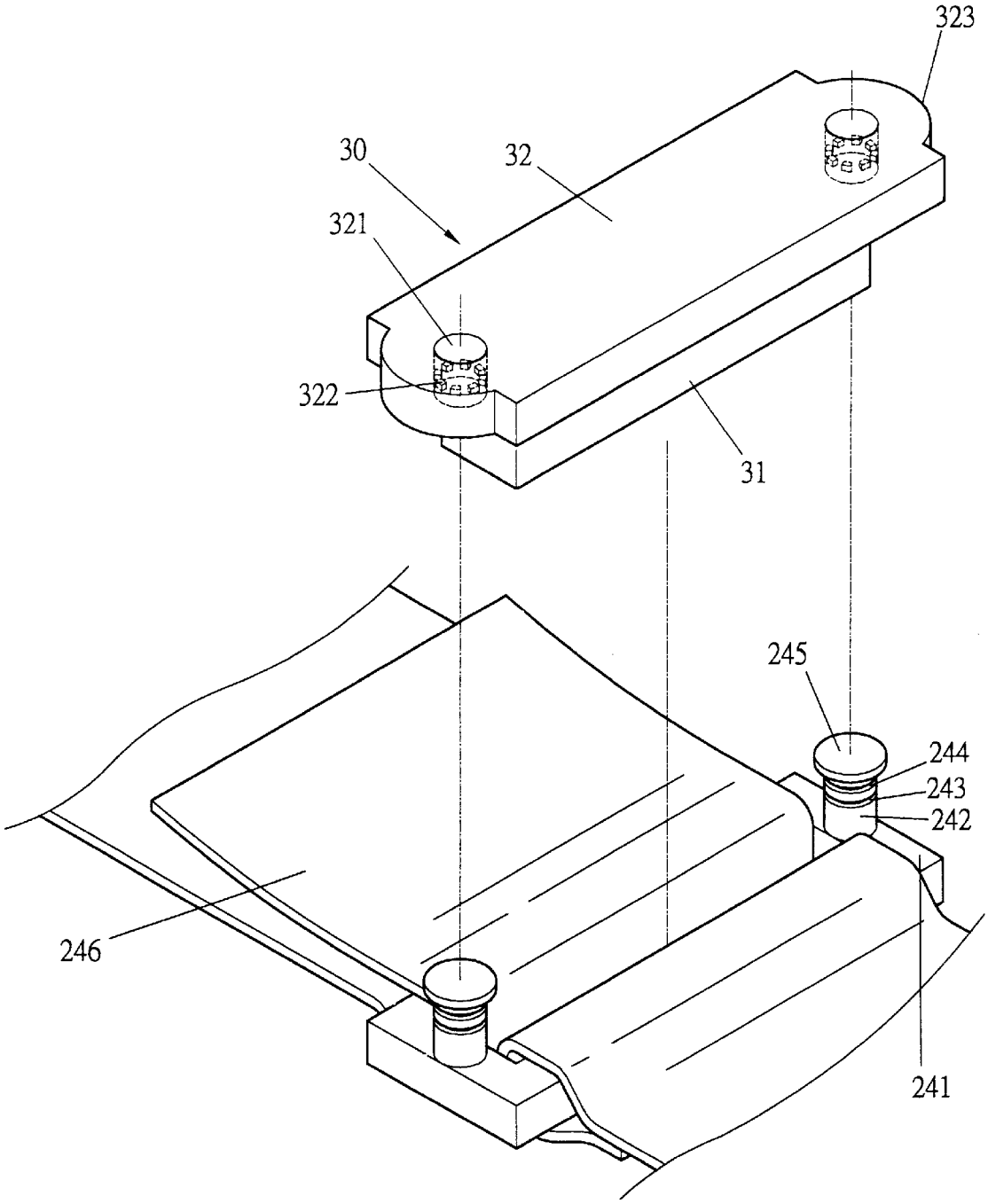
FIG. 2 is a perspective exploded view of an annular female fastening device and a T-shaped male fastening device of a preferred embodiment in accordance with the invention.
Figure 3:
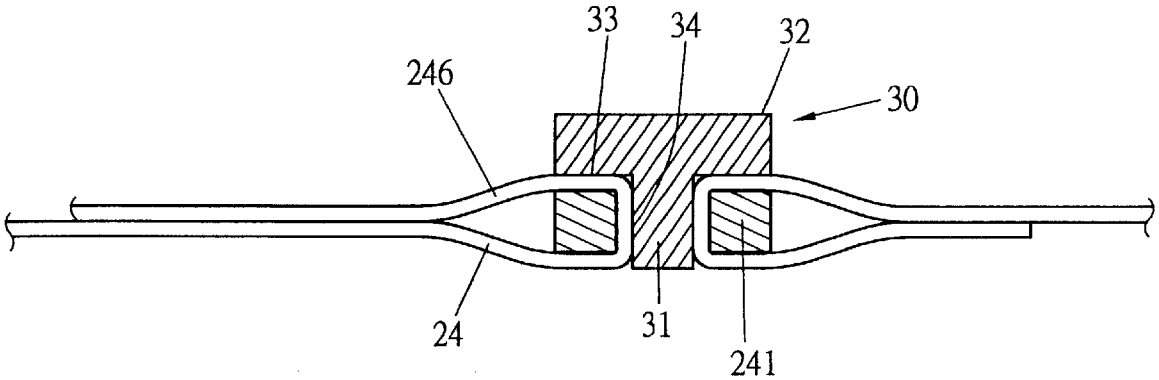
FIG. 3 is a sectional assembly view of an annular female fastening device and a T-shaped male fastening device while the T-shaped male fastening device is inserted in the annular female fastening device.

Referring to FIGS. 1 to 3, a swimming aid device comprises a generally grid-shaped frame 10, a hook and loop type toe strap 24, a hook and loop type instep strap 30, a hook and loop type heel strap 21, an annular female fastening device 241, a T-shaped male fastening device 31, at first blocking plate 2331, and a second blocking plate 2221.

The generally grid-shaped frame 10 has a plurality of spaced transverse bars 11, a plurality of spaced longitudinal rods 12, and a plurality of meshes 13 defined by the spaced transverse bars 11 and the spaced longitudinal rods 12.

Each transverse bar 11 is connected to a leaf 14. Each leaf 14 covers the respective mesh 13.

A reinforced rib 112 is disposed on a front portion of the generally grid-shaped frame 10 transversely.

A crossbar 111 is disposed on the front portion of the generally grid-shaped frame 10 between two of the longitudinal rods 12.

The hook and loop type toe strap 24 is disposed on the front portion of the generally grid-shaped frame 10.

A first positioning pad 113 is disposed on the front portion of the generally grid-shaped frame 10 to position a center portion of the hook and loop type toe strap 24.

The hook and loop type instep strap 22 is disposed on a generally central portion of the generally grid-shaped frame 10.

A second positioning pad 114 is disposed on the generally center portion of the generally grid-shaped frame 10 to position a center portion of the hook and loop type instep strap 22.

The hook and loop type heel strap 21 is disposed on a rear portion of the generally grid-shaped frame 10.

A third positioning pad 115 is disposed on the rear portion of the generally grid-shaped frame 10 to position a center portion of the hook and loop type heel strap 21.

A first cross strap 231 is disposed at an end portion of the hook and loop type instep strap 22.

A second cross strap 23 is connected to the hook and loop type instep strap 22 and the hook and loop type heel strap 21.

A first retaining ring 232 is disposed at a terminal end of the first cross strap 231.

A second retaining ring 221 is disposed at a terminal end of the second cross strap 23. A connection band 25 is disposed between the hook and loop type toe strap 24 and the hook and loop type instep strap 22.

The annular female fastening device 241 is disposed at a terminal end of the hook and loop type toe strap 24 to receive an end portion 246 of the toe strap 24. The annular female fastening device 241 has two upper positioning posts 242. Each of the upper positioning posts 242 has a disk head 245, a first annular recess 243, and a second annular recess 244.

The T-shaped male fastening device 30 engages with the annular female fastening device 241. The T-shaped male fastening device 30 has an upper plate 32, and a lower insertion block 31 inserted in the annular female fastening device 241. The upper plate 32 has two semicircular ends 323, and two through holes 321. A plurality of protruded blocks 322 are disposed in each of the through holes 321.

Each of the upper positioning posts 242 is inserted in the respective through holes 321.

Each of the protruded blocks 322 engages with the respective first annular recess 243 while the upper plate 32 is pressed downward so that the lower insertion block 31 is inserted in the annular female fastening device 241.

Each of the protruded blocks 322 engages with the respective second annular recess 244 while the upper plate 32 is pulled upward so that the lower insertion block 31 diesngages from the annular female fastening device 241.

The first blocking plate 2331 is disposed at an end portion 233 of the second cross strap 23. The first blocking plate 2331 has a first distal protruded bar 2332. A first spacing is defined between the first blocking plate 2331 and the end portion 233 of the second cross strap 23.

The second blocking plate 2221 is disposed at an end portion 222 of the hook and loop type instep strap 22. The second blocking plate 2221 has a second distal protruded bar 2222. A second spacing is defined between the second blocking plate 2221 and the end portion 222 of the hook and loop type instep strap 22.

The generally grid-shaped frame 10 has a front end 141. An additional leaf 14 is connected to the front end 141 of the generally grid-shaped frame 10. The additional leaf 14 does not cover the crossbar 111.

Figure 4:
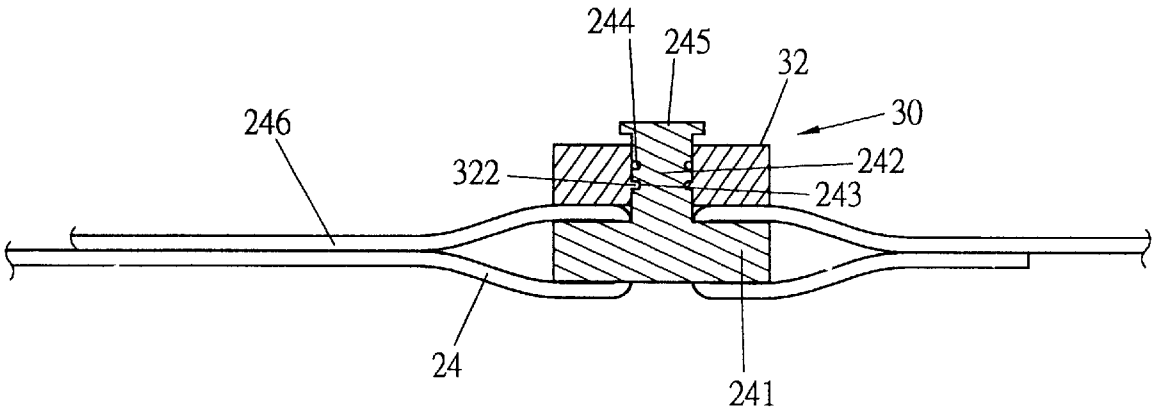
FIG. 4 is a sectional assembly view of an annular female fastening device and a T-shaped male fastening device while a positioning post of the annular female fastening device is inserted in a through hole of the T-shaped male fastening device.

Referring to FIGS. 1, 3 and 4, the T-shaped male fastening device 30 is pressed downward and the lower insertion block 31 is inserted in the annular female fastening device 241. Each of the protruded blocks 322 engages with the respective first annular recess 243 so that a bottom 33 of the upper plate 32 and a periphery 34 of the lower insertion block 31 press the end portion 246 of the hook and loop type toe strap 24 tightly. Therefore, the hook and loop type toe strap 24 will not be loosened from the annular female fastening device 241 after a long period of usage in water.

The user holds the semicircular ends 323 of the upper plate 32 in order to pull the upper plate 32 upward. When the T-shaped male fastening device 30 is pulled upward and the lower insertion block 31 disengages from the annular female fastening device 241, each of the protruded blocks 322 engages with the respective second annular recess 244. Therefore, the hook and loop type toe strap 24 will be loosened and the end portion 246 of the hook and loop type toe strap 24 will be detached from the annular female fastening device 241.

Figure 5:
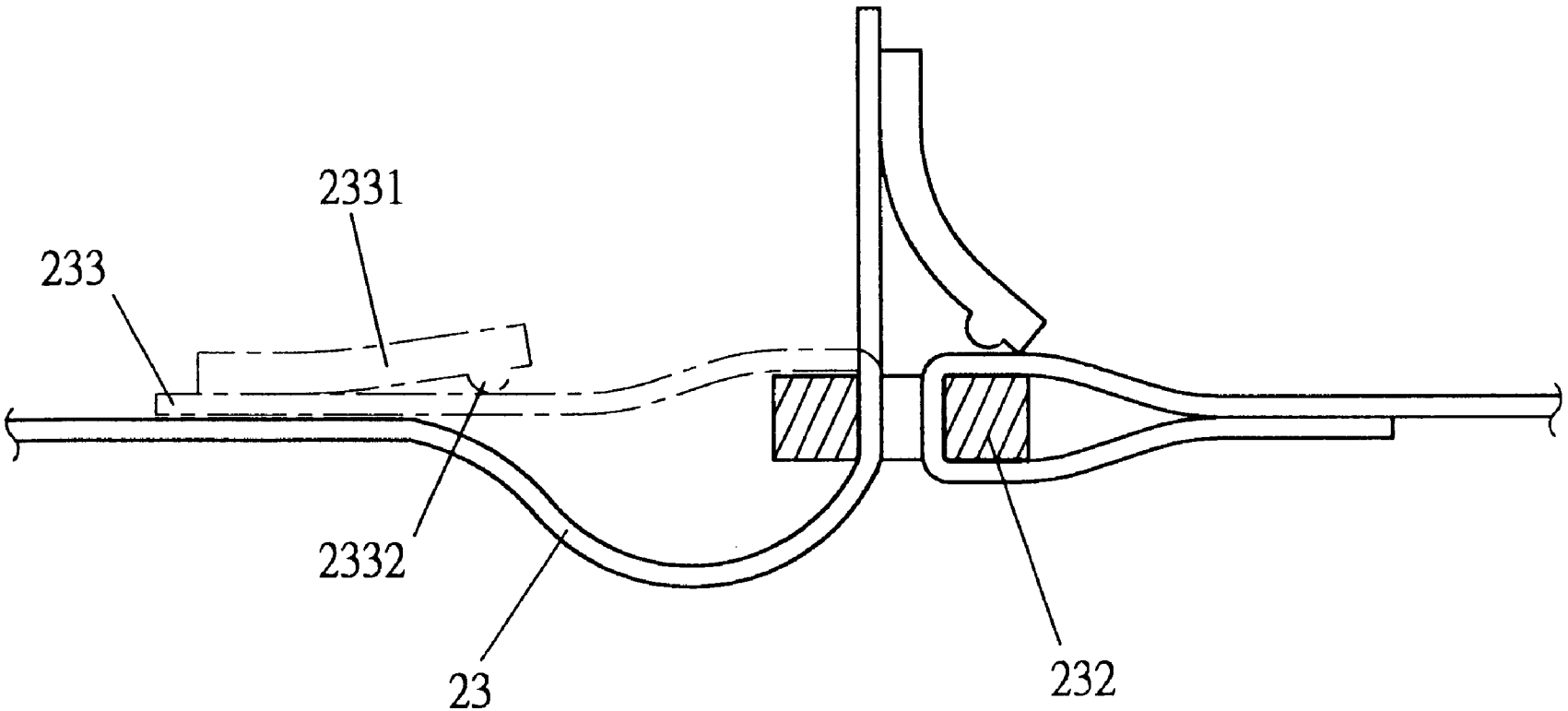
FIG. 5 is a schematic view illustrating a first plate having a distal hook blocking a first retaining ring.

Referring to FIGS. 1 and 5, the first blocking plate 2331 will not be released from the first retaining ring 232 while the second cross strap 23 is loosened. Because the first blocking plate 2331 has a first distal protruded bar 2332 and a first spacing is defined between the first blocking plate 2331 and the end portion 233 of the second cross strap 23, the first blocking plate 2331 will block the first retaining ring 232. Therefore, the user can operate the second cross strap 23 with one hand.

It is an option to replace the first annular recess 243 and the second annular recess 244 with annular flanges and to replace the protruded blocks 322 with recess holes.

It is an option to connect the protruded blocks 322 to form an annular flange.

The invention is not limited to the above embodiment but various modification thereof may be made. Further, various changes in form and detail may be made without departing from the scope of the invention.

I claim:

1. A swimming aid device comprises:

a generally grid-shaped frame, a hook and loop type toe strap, a hook and loop type instep strap, a hook and loop type heel strap, an annular female fastening device, a T-shaped male fastening device, a first blocking plate, and a second blocking plate, the generally grid-shaped frame having a plurality of spaced transverse bars, a plurality of spaced longitudinal rods, and a plurality of meshes defined by the spaced transverse bars and the spaced longitudinal rods, each said transverse bar connected to a leaf, each said leaf covering the respective mesh, a reinforced rib disposed on a front portion of the generally grid-shaped frame transversely, a crossbar disposed on the front portion of the generally grid-shaped frame between two of the longitudinal rods, the hook and loop type toe strap disposed on the front portion of the generally grid-shaped frame, a first positioning pad disposed on the front portion of the generally grid-shaped frame to position a center portion of the hook and loop type toe strap, the hook and loop type instep strap disposed on a generally central portion of the generally grid-shaped frame, a second positioning pad disposed on the generally central portion of the generally grid-shaped frame to position a center portion of the hook and loop type instep strap, the hook and loop type heel strap disposed on a rear portion of the generally grid-shaped frame, a third positioning pad disposed on the rear portion of the generally grid-shaped frame to position a center portion of the hook and loop type heel strap, a first cross strap disposed at an end portion of the hook and loop type instep strap, a second cross strap connected to the hook and loop type instep strap and the hook and loop type heel strap, a first retaining ring disposed at a terminal end of the first cross strap, a second retaining ring disposed at a terminal end of the second cross strap, the annular female fastening device disposed at a terminal end of the hook and loop type toe strap, the annular female fastening device having two upper positioning posts, each of the upper positioning posts having a disk head, a first annular recess, and a second annular recess, the T-shaped male fastening device engaging with the annular female fastening device, the T-shaped male fastening device having an upper plate, and a lower insertion block inserted in the annular female fastening device, the upper plate having two through holes, a plurality of protruded blocks disposed in each of the through holes, each of the upper positioning posts inserted in the respective through holes, each of the protruded blocks engaging with the respective first annular recess while the upper plate is pressed downward and the lower insertion block is inserted in the annular female fastening device, each of the protruded blocks engaging with the respective second annular recess while the upper plate is pulled upward and the lower insertion block disengages from the annular female fastening device, the first blocking plate disposed at an end portion of the second cross strap, the first blocking plate having a first distal protruded bar, the second blocking plate disposed at an end portion of the hook and loop type instep strap, and the second blocking plate having a second distal protruded bar.

2. The swimming aid device as claimed in claim 1, wherein the upper plate has two semicircular ends.

3. The swimming aid device as claimed in claim 1, wherein the protruded blocks are connected to form an annular flange.

4. The swimming aid device as claimed in claim 1, wherein an additional leaf is connected to a front end of the generally grid-shaped frame, and the additional leaf does not cover the crossbar.

* * * * *